United States Patent [19]

Yamagishi

[11] 3,952,722

[45] Apr. 27, 1976

[54] FIREPLACE ROOM HEATER ACCESSORY

[76] Inventor: Yoshishige Yamagishi, 796 Merritt Drive, Pasadena, Calif. 91104

[22] Filed: July 17, 1974

[21] Appl. No.: 489,130

[52] U.S. Cl. ..... 126/141; 126/288; 126/120

[51] Int. Cl.[2] ..... F23L 11/00; F24C 15/22

[58] Field of Search ..... 176/120, 121, 141, 288, 176/122–124, 138, 295; 237/51

[56] References Cited

UNITED STATES PATENTS

| | | | |
|---|---|---|---|
| 164,046 | 6/1875 | Spear | 126/141 |
| 280,411 | 7/1883 | Spear | 126/288 |
| 419,704 | 1/1890 | McMahen | 126/141 |
| 624,049 | 5/1899 | Kennedy | 126/288 |
| 3,802,415 | 4/1974 | Richard | 126/120 |

FOREIGN PATENTS OR APPLICATIONS

| | | | |
|---|---|---|---|
| 379,418 | 9/1932 | United Kingdom | 126/141 |
| 734,955 | 8/1955 | United Kingdom | 126/141 |
| 610,285 | 2/1935 | Germany | 126/120 |
| 614,184 | 12/1948 | United Kingdom | 126/141 |
| 821,950 | 10/1959 | United Kingdom | 126/288 |
| 856,876 | 12/1960 | United Kingdom | 126/288 |

*Primary Examiner*—John J. Camby
*Assistant Examiner*—Henry C. Yuen
*Attorney, Agent, or Firm*—White and Haefliger

[57] ABSTRACT

Unitized fireplace heat deflector comprising upper and lower sheet metal panels relatively angularly variable along a common hinge, the panels being mountable to the side walls of a fireplace opening by longitudinally adjustable terminal bearing rods at the top and bottom of the panel assembly.

2 Claims, 5 Drawing Figures

FIREPLACE ROOM HEATER ACCESSORY

SUMMARY OF THE INVENTION

This invention has to do with an improved fireplace accessory for recovering and directing into a room heat normally lost to the fireplace flue.

Generally contemplated is a unitized dual panel assembly releasably mountable to the side walls of a fireplace opening in overlying relation to the heat source, e.g. fuel in a grate, and serving both to deflect heat into the room and direct residual combustion gases to the fireplace flue.

Structurally the invention has for its object to provide such assembly of simple construction comprising upper and lower sheet metal panels to extend between the fireplace opening side walls, the upper panel being mountable with gas escape spacing from the rear fireplace wall with the lower panel extending downwardly and angularly to deflect heat into the room and to conduct heat to the overlying upper panel.

These and additional features and objects of the invention will be more fully understood from the following detailed description of illustrative embodiments.

DESCRIPTION OF THE PREFERRED EMBODIMENTS

Figure 1:
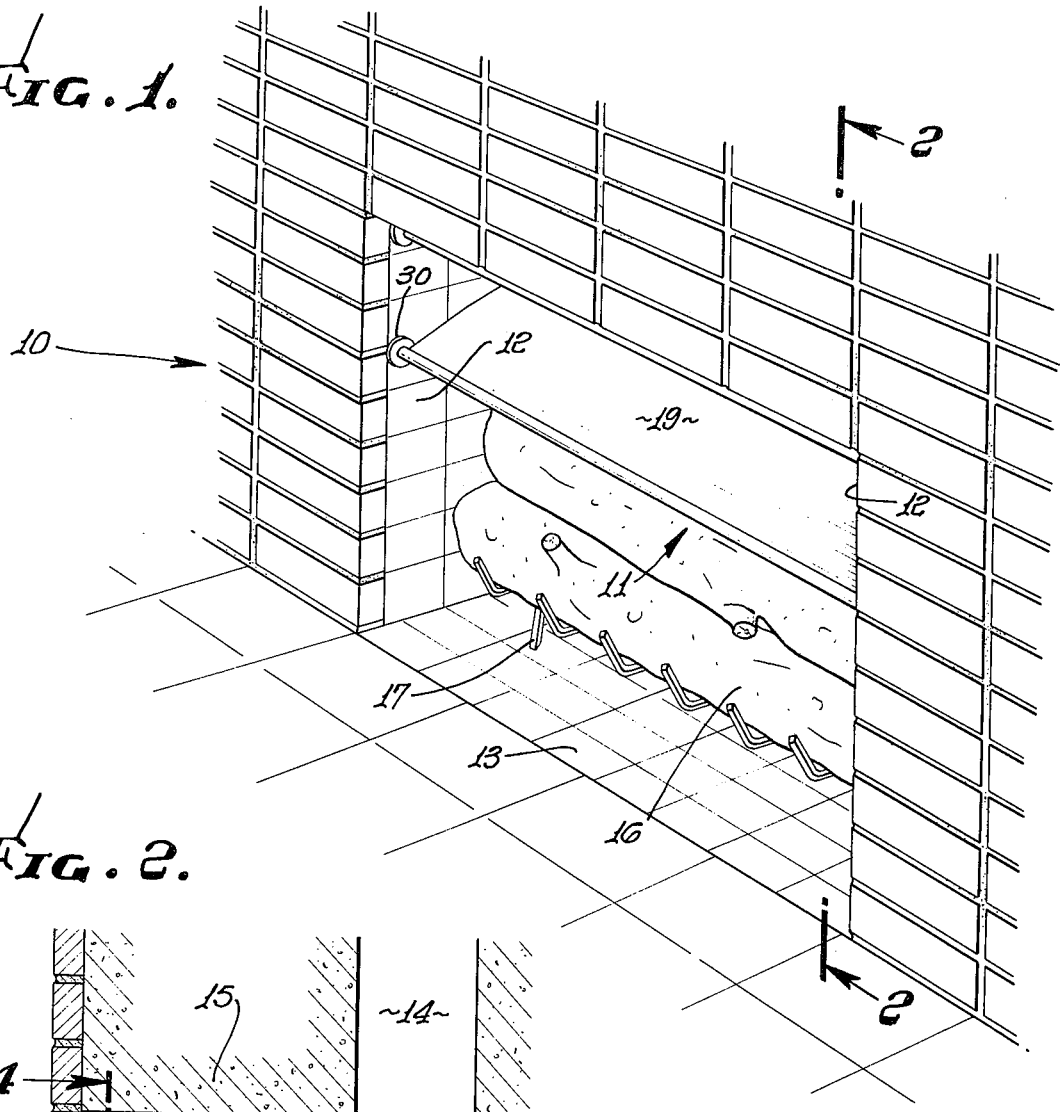
FIG. 1 is a view illustrative of a fireplace with the heat deflector assembly installed therein.

Referring to the drawings, the fireplace generally indicated at 10 is shown to contain a room heating deflector assembly generally indicated at 11 which is installed within the fireplace cavity defined by side walls 12, floor 13 and flue 14 between the masonries 15 and 15*a*. The heat source typically may comprise combustibles 16 supported on grate 17 in underlying relation to the heat deflector assembly.

Figure 2:
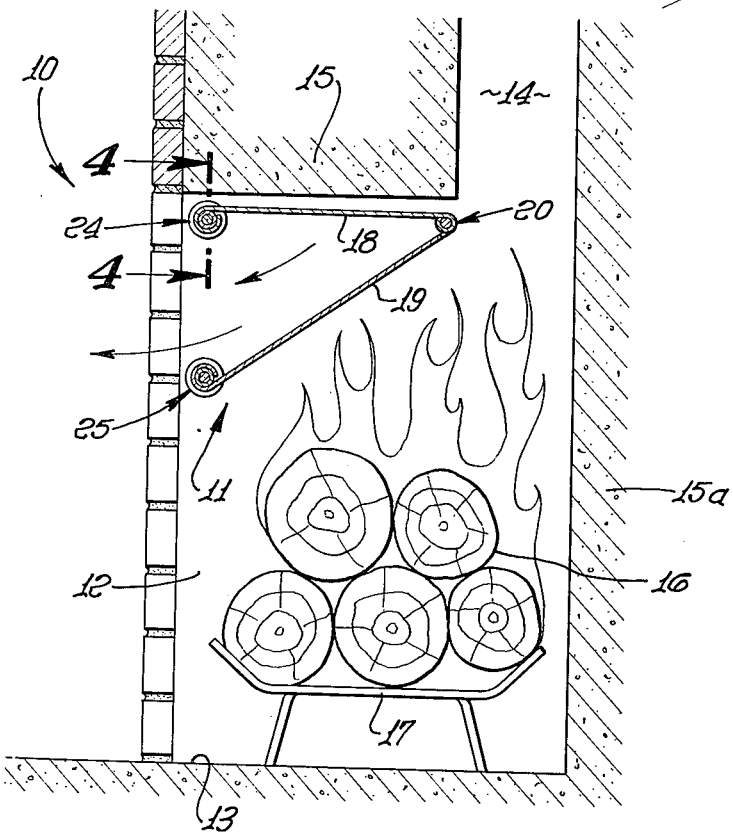
FIG. 2 is a vertical cross section taken on line 2—2 of FIG. 1.

That assembly is variably positioned within the fireplace and as illustrated is shown to comprise upper and lower heat conductive and reflective sheet metal panels 18 and 19 which may be formed of various sheet metals although constituted preferably of sheet iron whose composition and thickness corresponds to that of conventional stove pipe. The panels 18 and 19 are hinged at 20 so as to be relatively angularly adjustable to best advantage in a given fireplace installation. As shown in FIG. 2 the upper panel 18 may be positioned horizontally beneath and spaced from the overlying masonry 15 and panel 19 positioned in more direct overlying relation to the heat source for deflection of heat into the room area outside the fireplace.

Figure 3:
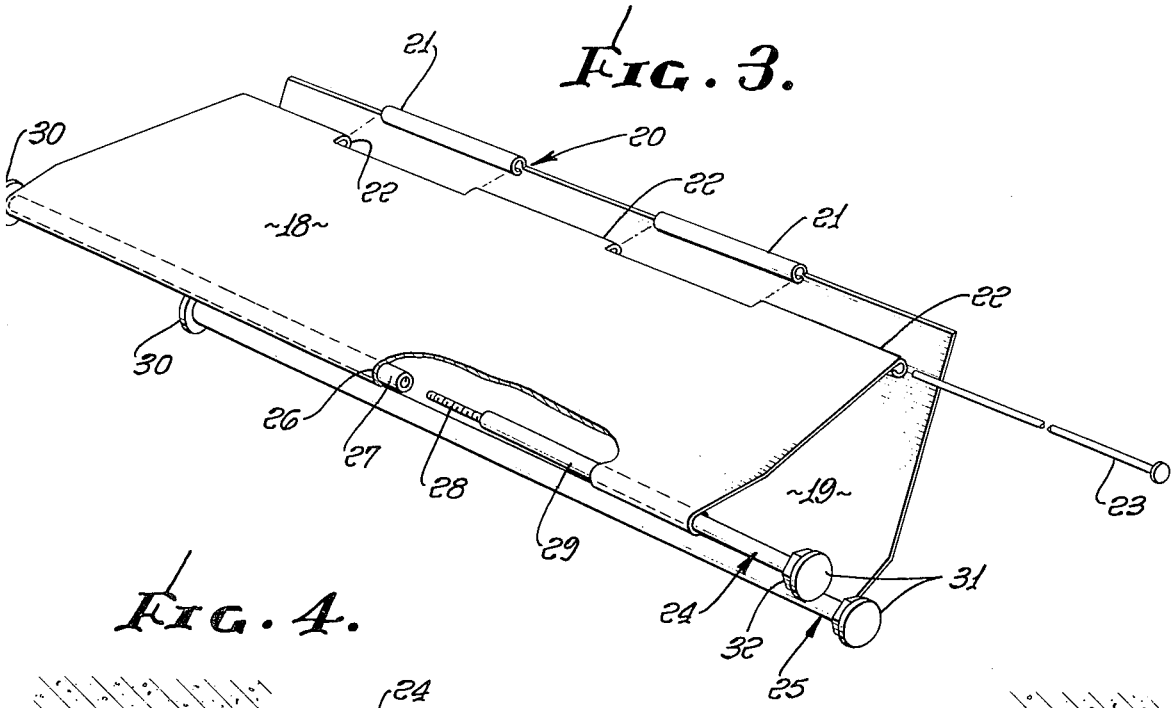
FIG. 3 is an exploded perspective showing details of the deflector assembly.

Referring to FIG. 3 the hinge structure at 20 may be simplified in construction by turning or looping the edge portions 21 of panel 19 for reception between similarly looped edges 22 of panel 18, the hinge being completed by insertion of pin or rod 23 through the alined loops.

Figure 4:
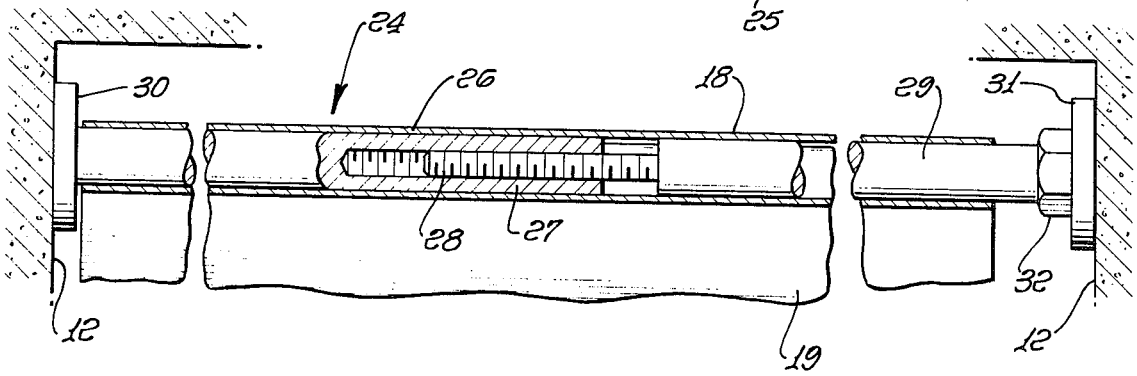
FIG. 4 is an enlarged cross section on line 4—4 of FIG. 2.

In reference now to FIG. 4 the panel assembly is mountable to the sides 12 of the fireplace opening by provision at the free panel edges of longitudinally expansible and contractible attachments generally indicated at 24 and 25 and each comprising, as detailed in FIG. 4, a tube 26 within which may be stationarily contained an insert 27 threaded to receive the threaded extension 28 of an axially adjustable insert section 29. Terminally the assembly has bearings or pads 30 and 31 which bear and may be tightened against the fireplace side walls and releasably held in engaging position by lock nut 32. Thus the mounts 24 and 25 may serve both to adjustably vary the relative angularities of the panels 18, 19, and also to releasably mount the assemblage to the fireplace side walls.

Figure 5:
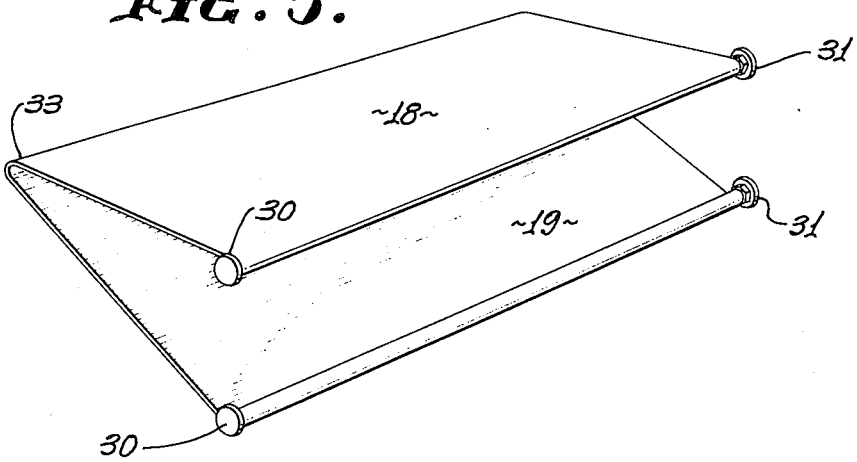
FIG. 5 is a showing in perspective of a variational form of the invention.

In FIG. 5, I show a simplified version of the dual panel arrangement in which the panels 18 and 19 are integrated along a common hinge edge 33 at which the panels may be angularly adjusted by flexure at their hinge edge.

The general function of the inclined panel 19 is to intercept and deflect into the room heat that otherwise would be lost by direct passage to the flue. Since the temperature to which panel 19 becomes heated may warrant further heat recovery, panel 18 functions to receive and reflect into the pocket between the panels heat conducted through the incline panel, thus maximizing heat recovery through the combined functioning of the panels.

It will be understood that the drawings are illustrative only of the invention in typical though preferred forms and that various changes and modifications may be made without departure from the intended spirit and scope of the invention.

I claim:

1. A heat deflector assembly for installation in a fireplace opening defined by spaced sidewalls, a rear wall and a floor, said assembly comprising an upper sheet metal panel mounted in spaced relation to said rear wall to permit combustion gas to escape to a flue, a lower sheet metal panel joined to said upper panel to extend therefrom at downward and forward inclination overlying the fireplace heat source on said floor to deflect heat into the fireplace room and conduct heat to the upper panel, said panels having looped free edges, and mounting means separately and releasably supporting the panels against the side walls of the fireplace opening, said mounting means comprising for each panel spaced rod sections contained within said looped free edges of the panels, said sections being threadedly interconnected for relative axial movement, one of the sections carrying a pad to bear against the fireplace sidewall by relative expansive axial adjustment of the sections.

2. A heat deflector assembly according to claim 1 in which said axially movable sections extend within and support a major extent of the sheet metal looped about them.

* * * * *